US011430386B2

(12) United States Patent
Kajimoto

(10) Patent No.: US 11,430,386 B2
(45) Date of Patent: Aug. 30, 2022

(54) DISPLAY APPARATUS

(71) Applicant: DENSO TEN Limited, Kobe (JP)

(72) Inventor: Nobuaki Kajimoto, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 17/361,470

(22) Filed: Jun. 29, 2021

(65) Prior Publication Data

US 2022/0044632 A1 Feb. 10, 2022

(30) Foreign Application Priority Data

Aug. 5, 2020 (JP) ..... JP2020-132970

(51) Int. Cl.
*G09G 3/3233* (2016.01)
*H04R 23/00* (2006.01)
*H04R 3/00* (2006.01)

(52) U.S. Cl.
CPC ..... *G09G 3/3233* (2013.01); *H04R 3/00* (2013.01); *H04R 23/00* (2013.01); *G09G 2330/021* (2013.01); *G09G 2330/04* (2013.01); *G09G 2360/16* (2013.01); *H04R 2430/01* (2013.01); *H04R 2499/15* (2013.01)

(58) Field of Classification Search
CPC ..... H04R 3/00; H04R 23/00; H04R 2430/01; H04R 2499/15; H04R 9/06; H04R 17/00; G09G 3/32–3291; G09G 3/34–3426; G09G 3/36–3696; G09G 2330/00–021; G09G 2330/04
See application file for complete search history.

(56) References Cited

U.S. PATENT DOCUMENTS

| | | | | |
|---|---|---|---|---|
| 10,290,281 | B2 * | 5/2019 | Ooi | G09G 5/10 |
| 10,310,582 | B2 * | 6/2019 | Park | H04B 5/0037 |
| 2014/0191747 | A1 * | 7/2014 | Chen | G09G 3/3406 324/103 R |
| 2016/0335989 | A1 * | 11/2016 | Ooi | H04N 5/232411 |
| 2017/0192486 | A1 * | 7/2017 | Park | G06F 1/3278 |
| 2022/0043498 | A1 * | 2/2022 | Kajimoto | G06F 1/28 |
| 2022/0044632 | A1 * | 2/2022 | Kajimoto | H04R 3/00 |

FOREIGN PATENT DOCUMENTS

| | | | | |
|---|---|---|---|---|
| JP | 2015-172723 | A | 10/2015 | |
| WO | WO-2014148524 | A1 * | 9/2014 | G09G 3/3406 |

* cited by examiner

*Primary Examiner* — Patrick F Marinelli
(74) *Attorney, Agent, or Firm* — Oliff PLC

(57) ABSTRACT

A display apparatus includes a display, a loudspeaker and a controller. The controller is configured to: perform, based on one or both of (i) image information of an image that is displayed on the display, and (ii) sound information of sound that is output from the loudspeaker, electric current control processing that controls a sum of an electric current to be supplied to the display and an electric current to be supplied to the loudspeaker.

14 Claims, 7 Drawing Sheets

DISPLAY APPARATUS

BACKGROUND OF THE INVENTION

Field of the Invention

The invention relates to a display apparatus, a display system and a controlling method of a display apparatus.

Description of the Background Art

Conventionally, a display apparatus has been known that decreases a drive electric current that is supplied to light emitting elements of the display apparatus when a voltage of power supplied from a battery is a threshold value or smaller. Moreover, for example, a technology has been known that decreases luminance of an organic electroluminescence display to move the display into a power saving mode when a battery voltage of a mobile device, such as a smartphone and a tablet device, is low.

In a case of a display apparatus that includes a loudspeaker, the loudspeaker consumes an electric current in addition to the display. Therefore, even if the display is changed into the power saving mode, when an output from the loudspeaker is high, an electric current consumption may not be decreased enough. Especially, in the display apparatus that is supplied with power by a wire harness, an electric current greater than an allowable electric current should not flow in the wire harness. When the output from the loudspeaker is high even in the power saving mode, the electric current greater than the allowable electric current may flow in the wire harness. Moreover, the frequent change into the power saving mode causes frequent decrease in luminances of the images so that there is a possibility that a user of the display apparatus may feel difficult to watch the images.

SUMMARY OF THE INVENTION

According to one aspect of the invention, a display apparatus includes a display, a loudspeaker and a controller. The controller is configured to: perform, based on one or both of (i) image information of an image that is displayed on the display, and (ii) sound information of sound that is output from the loudspeaker, electric current control processing that controls a sum of an electric current to be supplied to the display and an electric current to be supplied to the loudspeaker.

An object of this invention is to provide a technology that prevents an electric current flow greater than an allowable electric current in a wire harness for a display apparatus that is supplied with power by the wire harness.

These and other objects, features, aspects and advantages of the invention will become more apparent from the following detailed description of the invention when taken in conjunction with the accompanying drawings.

DESCRIPTION OF THE EMBODIMENTS

An exemplary embodiment of the invention will be described below with reference to the drawings.

1. DISPLAY SYSTEM

Figure 1:
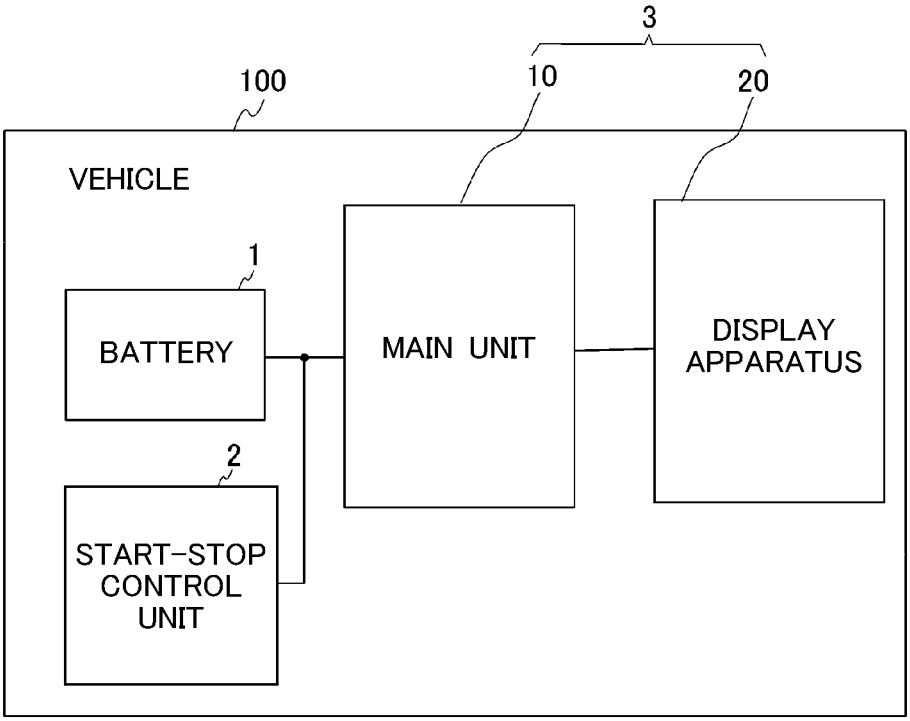
FIG. 1 is a schematic diagram showing a configuration of a vehicle in which a display system is installed.

FIG. 1 is a schematic diagram showing a configuration of a vehicle 100 in which a display system 3 of the embodiment is installed. More specifically, the vehicle 100 is an automobile. However, a vehicle that includes the display system 3 of this embodiment may be a vehicle other than an automobile, such as a train vehicle. As shown FIG. 1, the vehicle 100 includes a battery 1, a start-stop control unit 2, and the display system 3.

The battery 1 is, for example, a lead-acid battery. The battery 1 supplies power to electrical devices, units, components etc. in the vehicle 100. The battery 1 is disposed, for example, in an engine compartment of the vehicle 100.

The start-stop control unit 2 includes an electronic control unit. The start-stop control unit 2 is supplied with the power from the battery 1. The start-stop control unit 2 stops an engine (not illustrated) of the vehicle 100 based on a predetermined stop condition, and restarts the engine of the vehicle 100 based on a predetermined restart condition. In other words, the vehicle 100 includes a start-stop function.

The predetermined stop condition is defined, for example, as a state in which the vehicle 100 is being stopped and the vehicle 100 can stop idling of the engine. A state in which the vehicle 100 can stop idling of the engine means a state in which even if the vehicle 100 stops the idling, the vehicle 100 can maintain enough braking force, and power is stored in the battery 1 to restart the engine. Whether or not the vehicle 100 is stopped is determined, for example, based on a signal indicative of revolution per minute of the engine, a signal indicative of speed of the vehicle 100, etc. Whether or not the vehicle 100 can maintain the braking force is determined based on, for example, a signal indicative of a brake negative pressure. A power storage status of the battery 1 is determined, for example, based on a signal indicative of a voltage of the battery 1.

Moreover, the predetermined restart condition is defined, for example, as a detection of a user (driver) operation to restart the engine of the vehicle 100 or a detection of an event that should restart the engine of the vehicle 100. The user operation to restart the engine of the vehicle 100 is determined, for example, based on a signal indicative of presence/absence of a brake operation, a signal indicative of an accelerator pedal opening degree, etc.

The display system 3 includes a main unit 10 and a display apparatus 20. The main unit 10 and the display apparatus 20 are installed in the vehicle 100. The main unit 10 is supplied with the power from the battery 1. The main unit 10 is electrically connected to the battery 1 by, for example, a wire harness. Some examples of the main unit 10 are a navigation apparatus, an audio apparatus, a display audio, and a navigation apparatus having an audio function.

The display apparatus 20 is connected to the main unit 10 by a wire harness 30. The display apparatus 20 is supplied with power by the wire harness 30. The battery 1 is a power source of the display apparatus 20. The wire harness 30 is an aggregation that is a bundle of wires for power supply and signal communication. As shown in this embodiment, the main unit 10 is easily electrically connected to the display apparatus 20 by use of the wire harness 30.

In this embodiment, the display apparatus 20 is a device for watching television, a DVD content, and the like in a rear seat in a cabin of the vehicle 100. The display apparatus 20 is for so-called rear seat entertainment (RSE) system. The display apparatus 20 is arranged, for example, on a backside of a driver seat, a passenger seat or the like in a front row, on a ceiling of the cabin, etc. The voltage (ex. 12 V) of the battery 1 is boosted to a predetermined voltage (ex. 24 V), and a display of the display apparatus 20 works with the power at the predetermined voltage.

2. DISPLAY APPARATUS

Figure 2:
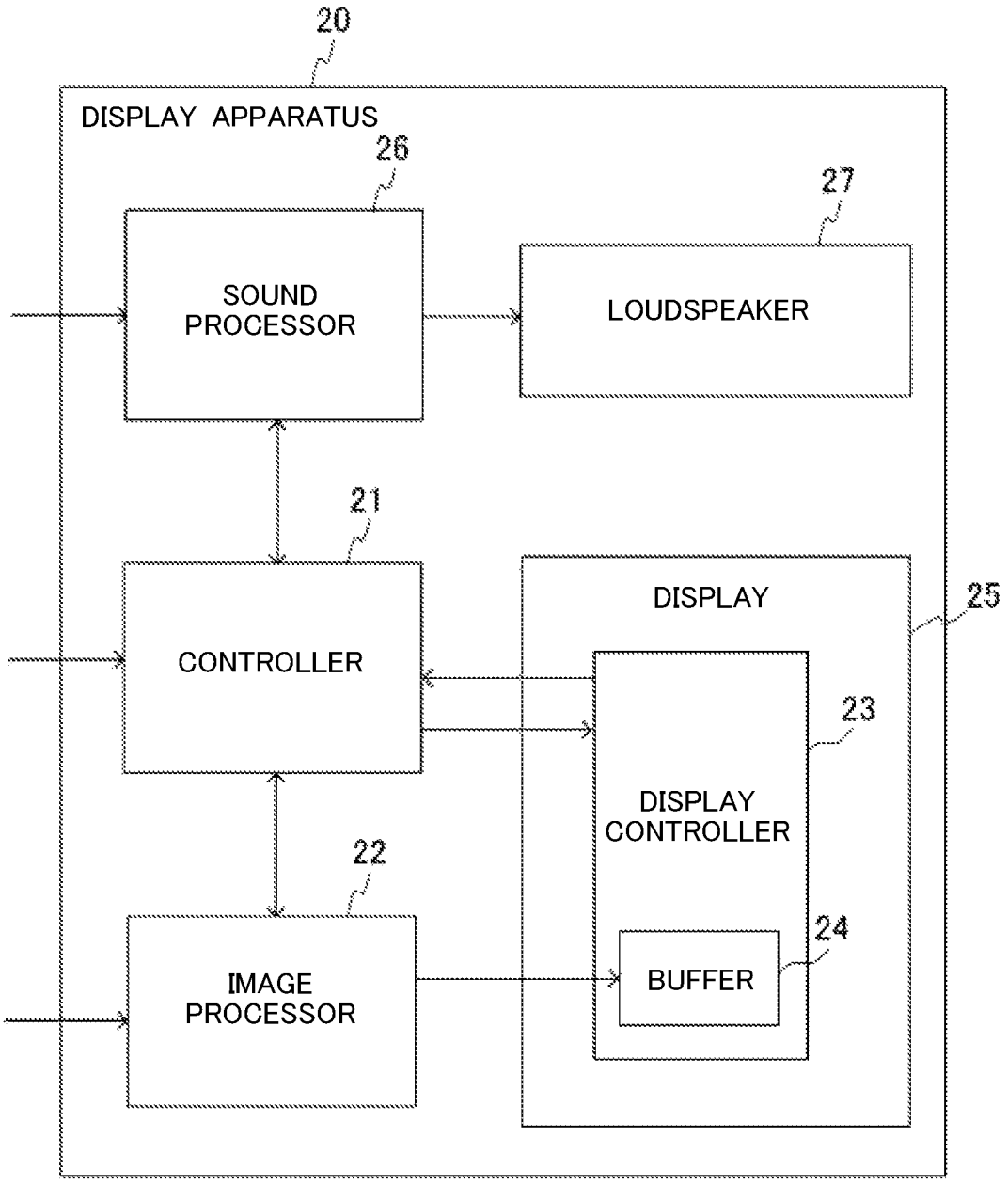
FIG. 2 is a block diagram showing a configuration of a display apparatus.

FIG. 2 is a block diagram showing a configuration of the display apparatus 20 of this embodiment. As shown in FIG. 2, the display apparatus 20 includes a controller 21, an image processor 22, a display controller 23, a buffer memory 24 (hereinafter referred to simply as "buffer"), the display 25, a sound processor 26 and a loudspeaker 27.

The controller 21 controls the entire display apparatus 20. In this embodiment, the controller 21 is a computer including, for example, a central processing unit (CPU), a random access memory (RAM), a read only memory (ROM), etc. In this embodiment, the controller 21 performs voltage monitoring processing for monitoring the voltage of the battery 1. Moreover, the controller 21 performs electric current control processing that controls a sum of an electric current to be supplied to the display 25 and an electric current to be supplied to the loudspeaker 27. In this embodiment, the electric current control processing temporarily controls the sum of the electric currents to be supplied to the display 25 and the loudspeaker 27. The controller 21 performs the electric current control processing based on one or both of (i) information of an image that is displayed on the display 25 and (ii) information of sound that is output from the loudspeaker 27.

According to the configuration of this embodiment, when an electric current consumption of the display apparatus 20 is estimated to be great from one or both of (i) the information of the image (hereinafter referred to also as "image information") and (ii) the information of the sound (hereinafter referred to also as "sound information"), the electric current control processing is performed to cause the electric current consumption to decrease. In other words, according to this configuration, an electric current flow greater than an allowable electric current in the wire harness 30 can be properly prevented.

The voltage monitoring processing and the electric current control processing are functions that are realized by a CPU that performs an arithmetic processing based on a program stored in a memory, such as a ROM. Details of the voltage monitoring processing and the electric current control processing will be described later.

The image processor 22 performs various types of processing for the image information (image signal) input from an outside of the image processor 22. The image processor 22 is an integrated circuit. Some examples of the processing that is performed, if necessary, by the image processor 22 are combining the images, enlarging/reducing a size of the image, and/or adjusting a color tone of the image. The image processor 22 sends the processed image information to the display controller 23 by, for example, low voltage differential signaling (LVDS).

In this embodiment, the image information is input from the main unit 10 in a communication method, such as gigabit video interface (GVIF) and IEEEBUS.

The display controller 23 controls the display 25. The display controller 23 is, for example, an application specific integrated circuit (ASIC). In this embodiment, the display controller 23 includes the buffer 24. More specifically, the image information output from the image processor 22 is input to the buffer 24. The buffer 24 temporarily stores the image information of the image that is displayed on the display 25. The buffer 24 is, for example, a line buffer. The buffer 24 may be separated from the display controller 23.

In this embodiment, the display controller 23 calculates an arithmetic value for an electric current consumption of the display 25 based on pixel value information included in the image information stored in the buffer 24. In other words, the display controller 23 functions as a calculator that calculates the arithmetic value. The display apparatus 20 includes the calculator 23 that calculates the arithmetic value for the electric current consumption of the display 25 based on the pixel value information included in the image information stored in the buffer 24. The arithmetic value calculated by the calculator 23 is sent to the controller 21 in a communication method, such as a serial peripheral interface (SPI). Processing performed by the calculator 23 to calculate the arithmetic value will be described later in details.

Figure 3:
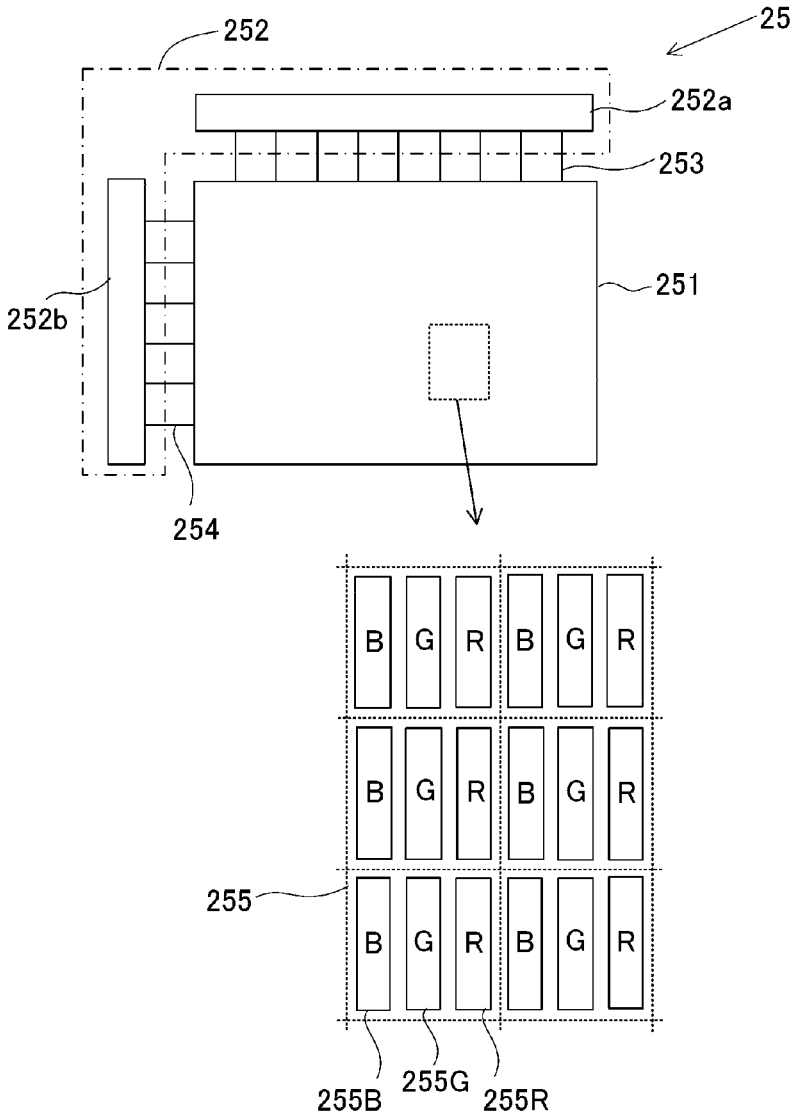
FIG. 3 is a schematic diagram showing an OLED display.

The display 25 displays the image under control of the display controller 23 based on the image information input from the image processor 22. In this embodiment, the display 25 is an organic electroluminescence (hereinafter referred to also as "OLED") display. FIG. 3 is a schematic diagram showing the OLED display 25. The OLED display 25 includes an OLED panel 251 and a panel drive circuit 252. The panel drive circuit 252 includes a column driver 252*a* and a row driver 252*b*.

The OLED panel 251 displays the image by drive of the column driver 252*a* and the row driver 252*b*. The column driver 252*a* provides a signal to a signal line 253. The row driver 252*b* provides a signal to a scan line 254. A plurality of the signal lines 253 and a plurality of the scan lines 254 are arranged in a matrix form on the OLED panel 251. When the OLED panel 251 displays the image, while the row driver 252*b* is cyclically scanning the plurality (M lines) of the scan lines 254, the column driver 252*a* provides an electrical signal to at least one of the plurality (N lines) of the signal lines 253 so that an organic electroluminescence diode (not illustrated) at an intersection of the signal line 253 and the scan line 254 emits light. Thus, the image is displayed on the OLED panel 251.

Pixels 255 are arranged in a two-dimensional matrix form on an image display surface of the OLED panel 251. Each of the pixels 255 includes a first subpixel 255R, a second subpixel 255G, and a third subpixel 255B. In this embodiment, the first subpixel 255R emits red light, the second subpixel 255G emits green light, and the third subpixel 255B emits blue light. In other words, organic light emitting diodes that emit red light, green light, and blue light are arranged as the subpixels 255R, 255G and 255B, respectively. Each of the pixels 255 controls luminances of the subpixels 255R, 255G and 255B so as to emit light in various colors. More specifically, the pixel value information included in the image information includes pixel values (luminance value) of the three subpixels 255R, 255G and 255B of the pixels 255.

Number of subpixels included in each of the pixels 255 of the OLED panel 251 is not limited to three described in this embodiment and may be changed properly. Combination of the colors that the subpixels emit may be changed properly. For example, each of the pixels 255 of the OLED panel 251 may include four subpixels that emit red light, green light, blue light, and white light, respectively.

With reference back to FIG. 2, the sound processor 26 performs various types of processing for sound information (sound signal) input from an outside of the sound processor 26. In this embodiment, the sound information is input from the main unit 10. The sound processor 26 is a digital signal processor (DSP). The sound processor 26 adjusts a level (volume) of an input sound signal, for example, in accordance with a volume set for the loudspeaker 27 of the display apparatus 20. The sound processor 26 outputs the processed sound information to the loudspeaker 27.

The loudspeaker 27 includes a speaker drive circuit, not illustrated in the drawings. The loudspeaker 27 outputs sound in accordance with the sound information sent from the sound processor 26. A configuration of the loudspeaker 27 is not specifically limited. For example, the loudspeaker 27 is configured to include a voice coil and a diaphragm that is vibrated by the voice coil.

A portion of functions performed by the controller 21, the image processor 22, the display controller 23 including the buffer 24, and the sound processor 26 may be performed by software by use of an integrated circuit such as a microcomputer. For example, a portion of the functions that are performed by the image processor 22, the display controller 23 or the sound processor 26 in this embodiment may be performed by the controller 21.

Figure 4:
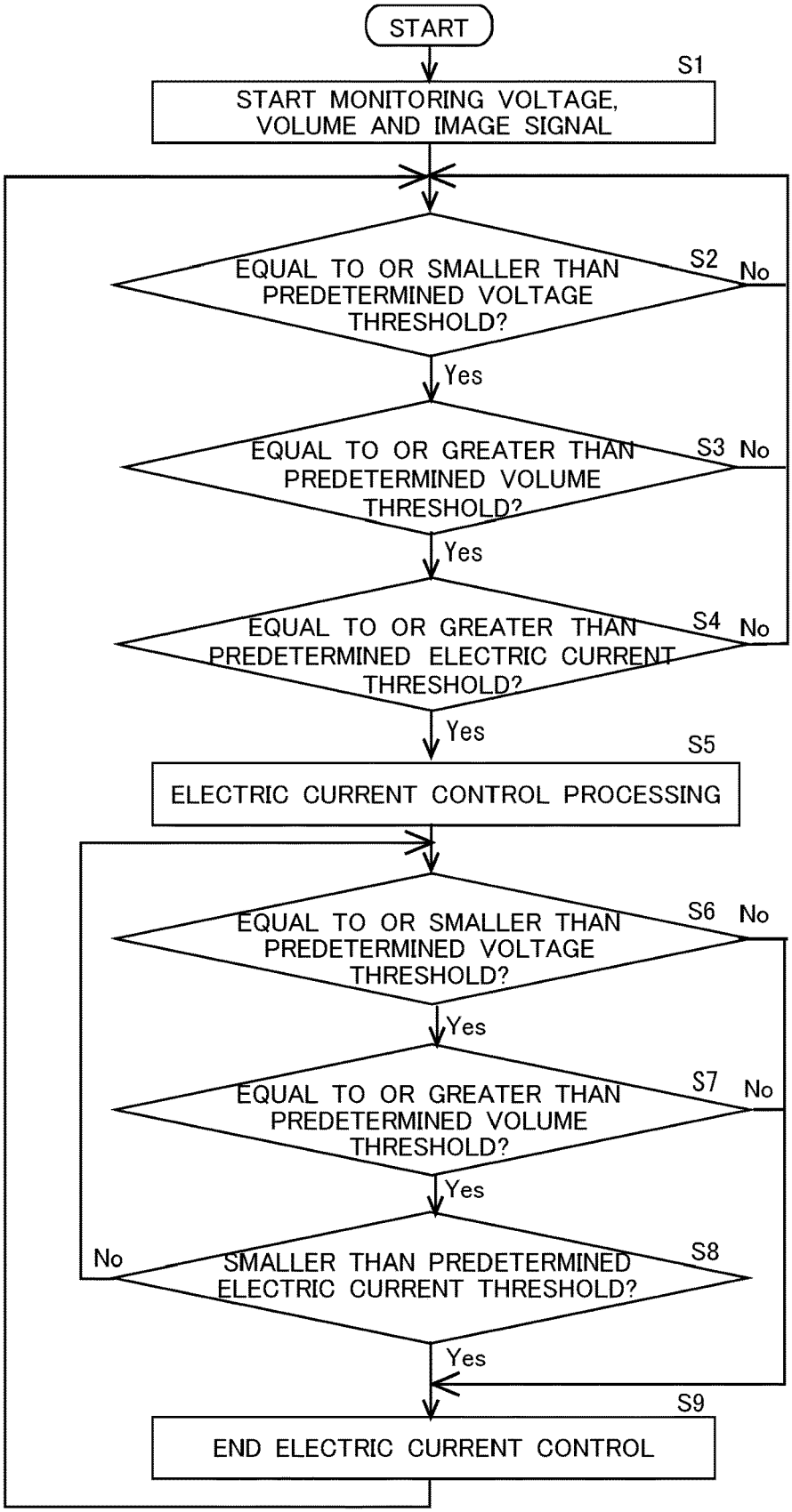
FIG. 4 is a flowchart showing electric current control processing that is performed by the display apparatus.

FIG. 4 is a flowchart showing the electric current control processing (hereinafter also referred to simply as "electric current control") that is performed by the display apparatus 20 in this embodiment. The electric current control shown in FIG. 4 is repeated while an image is being displayed or sound is being output by the display apparatus 20. The electric current control shown in FIG. 4 is not performed while no image is being displayed or no sound is being output by the display apparatus 20.

In a step S1, the voltage monitoring processing (hereinafter also referred to simply as "voltage monitoring"), volume monitoring and image signal monitoring are started. The voltage monitoring processing is for monitoring the voltage of the battery 1. The voltage monitoring is performed by the controller 21 that receives a voltage value of the battery 1. The volume monitoring is for monitoring a volume of the sound that is output by the loudspeaker 27. The volume monitoring is performed by the controller 21 that receives and sends the information from/to the sound processor 26. The image signal monitoring is for monitoring the electric current consumption of the display 25. When the image signal monitoring is started, the display controller (calculator) 23 starts processing that calculates the arithmetic value for the electric current consumption of the display 25. Moreover, monitoring of the arithmetic value is started by the controller 21 that receives the arithmetic value from the display controller 23. When the voltage monitoring, the volume monitoring, and the image signal monitoring are started, the processing moves to a next step S2.

Before an explanation of the step S2, the foregoing arithmetic value for the electric current consumption of the display 25 will be described. The arithmetic value for the electric current consumption of the display 25 is calculated based on the pixel value information included in the image information that is stored in the buffer 24. The display 25 that includes the OLED panel 251 consumes more electric current as a luminance of the image that is displayed on the display 25 is higher. If the pixel value of each pixel of the image that is displayed on the display 25 is obtained, the electric current consumption can be estimated. Thus, the arithmetic value for the electric current consumption of the display 25 is calculated based on the pixel value of each pixel of the image that is displayed on the display 25. The arithmetic value may be the electric current value of the estimated electric current consumption. However, the arithmetic value may be a value other than the electric current value if the electric current consumption of the display 25 can be estimated based on the value.

For example, in a case where the buffer 24 is a line buffer, the arithmetic value for the electric current consumption of the display 25 may be calculated, for example, as shown below. The display controller 23 takes one scan line 254 of the OLED panel 251 in order. The display controller 23 sums pixel values of the pixels 255 (more specifically, each pixel has values of the three subpixels R, G, and B) on the one scan line 254 of a frame of the images to calculate a line value of the one scan line 254. Then the display controller 23 adds the line value of the one scan line 254 to a sum of previously calculated line values to derive a sum so far. The display controller 23 repeats the calculation. When the frame is changed to another, the display controller 23 resets the values. The values are reset to zero. Whenever the display controller 23 derives the sum, the display controller 23 calculates a brightness ratio (ex. expressed by percentage) by dividing the sum by a sum of all pixel values of a white image frame that consists of pixels that are all white.

When the brightness ratio is calculated, the electric current consumption of the display 25 can be estimated. In other words, the brightness ratio is one of the arithmetic values for the electric current consumption of the display 25. Once calculating the brightness ratio, the display controller 23 sends the calculated brightness ratio as the arithmetic value to the controller 21. The display controller 23 may send, to the controller 21, a value of the electric current consumption estimated based on the brightness ratio. Moreover, the display controller 23 may be configured to send, to the controller 21, the foregoing sum as the arithmetic value for the electric current consumption. In this case, the foregoing brightness ratio may be calculated by the controller 21.

In the step S2, the controller 21 determines whether or not the voltage (voltage value) of the battery 1 is equal to or smaller than a predetermined voltage threshold. The predetermined voltage threshold may be experimentally determined. The predetermined voltage threshold may be, for example, a voltage value of the battery 1 that is decreased due to idling control (stop) of the engine of the vehicle 100. A failure caused by a decrease in voltage of the battery 1 during the idling control of the engine of the vehicle 100 can be improved by setting the predetermined voltage threshold as shown above.

When the voltage value of the battery 1 is equal to or smaller than the predetermined voltage threshold (Yes in the step S2), the controller 21 moves to a next step S3. Meanwhile, when the voltage value of the battery 1 is greater than the predetermined voltage threshold (No in the step S2), the controller 21 repeats the step S2, a determination step.

In the step S3, the controller 21 determines whether or not the set volume of the sound that is output from the loudspeaker 27 is equal to or greater than a predetermined volume threshold. In other words, in this embodiment, the sound information that is used by the controller 21 for the electric current control processing includes the set volume of the loudspeaker 27. More specifically, the controller 21 determines whether the set volume by the sound processor 26 is equal to or greater than the predetermined volume threshold. When the set volume of the loudspeaker 27 is high, the output from the loudspeaker 27 is high so that the electric current consumption is great. For example, the predetermined volume threshold may be determined from, for example, experiments in consideration of preventing an electric current flow greater than the allowable electric current in the wire harness 30 even when the voltage of the battery 1 is low.

For example, in a case where some volume values are prepared in advance for the loudspeaker 27, the predetermined volume threshold may be selected from amongst the prepared volume values. For example, in a case where the volume of the loudspeaker 27 is selected from amongst a volume 1, a volume 2, and a volume 3 and the volume 3 is louder than the volume 2 that is louder than the volume 1, the predetermined volume threshold may be the volume 2. In this case, when the set volume of the loudspeaker 27 is the volume 2 or the volume 3, the controller 21 determines that the set volume is equal to or greater than the predetermined volume threshold.

When the set volume is equal to or greater than the predetermined volume threshold (Yes in the step S3), the controller 21 moves to a next step S4. When the set volume is smaller than the predetermined volume threshold (No in the step S3), the controller 21 moves back to the step S2.

In the step S4, the controller 21 determines, based on the arithmetic value input from the display controller 23, whether the electric current consumption of the display 25 is estimated to be equal to or greater than the predetermined electric current threshold. The controller 21 may convert the arithmetic value input from the display controller 23 into an electric current consumption value to determine whether or not the converted value is equal to or greater than the predetermined electric current threshold. In this case, for example, the predetermined electric current threshold may be determined from, for example, experiments, in consideration of the predetermined volume threshold, to prevent an electric current flow greater than the allowable electric current in the wire harness 30 even when the voltage of the battery 1 decreases (or the voltage of the battery 1 is low).

In a case where the arithmetic value is the foregoing brightness ratio, a predetermined brightness ratio threshold may be set, and the controller 21 may be configured to determine whether the electric current consumption of the display 25 is estimated to be equal to or greater than the predetermined electric current threshold by comparing the arithmetic value to the predetermined brightness ratio threshold. The predetermined brightness ratio threshold may be determined from experiments similarly to the predetermined electric current threshold. The predetermined brightness ratio threshold is derived, for example, as below. The brightness ratio 100% is a value for a case in which all the pixels of an image frame are white. The predetermined brightness ratio threshold is derived, for example, by multiplying 100% of the brightness ratio by a figure greater than zero and smaller than one. For example, in a case where the predetermined brightness ratio threshold is 50%, when a brightness ratio calculated as the arithmetic value is 50% or greater, the electric current consumption of the display 25 is estimated to be equal to or greater than the predetermined electric current threshold.

When the electric current consumption of the display 25 is estimated to be equal to or greater than the predetermined electric current threshold based on the arithmetic value input from the display controller 23 (Yes in the step S4), the controller 21 moves to a next step S5. When the electric current consumption of the display 25 is estimated not to be equal to or greater than the predetermined electric current threshold (No in the step S4), the controller 21 moves back to the step S2.

In the step S5, the controller 21 performs the electric current control processing that decreases the sum of the electric current to be supplied to the display 25 and the electric current to be supplied to the loudspeaker 27. In other words, in this embodiment, when a condition is satisfied that the electric current consumption of the display 25 is estimated to be equal to or greater than the predetermined electric current threshold from the arithmetic value and also the set volume of the loudspeaker 27 is equal to or greater than the predetermined volume threshold, the controller 21 performs the electric current control processing. According to this embodiment, when the image that is displayed on the display 25 is estimated to be bright and also the output from the loudspeaker 27 is high, the electric current control processing is performed. Thus, an electric current flow greater than the allowable electric current in the wire harness 30 can be prevented. Moreover, only when the image is so bright that the electric current consumption of the display 25 is estimated to be high and also the set volume of the loudspeaker 27 is high, for example, a change is made to the image that is displayed on the display 25. Thus, a possibility that the user feels difficult to watch the image can be reduced.

Moreover, in this embodiment, the controller 21 performs the electric current control processing on the additional condition that the voltage of the battery 1, the power source of the display apparatus 20, is equal to or smaller than the predetermined voltage threshold. In other words, in this embodiment, the electric current control processing is performed when the three conditions are satisfied, (i) the voltage value of the battery 1 is equal to or smaller than the predetermined voltage threshold, (ii) the electric current consumption of the display 25 is estimated to be equal to or greater than the predetermined electric current threshold from the arithmetic value calculated by the display controller 23, and (iii) the set volume of the loudspeaker 27 is equal to or greater than the predetermined volume threshold.

According to that, when the voltage of the battery 1 is low, one or both of (i) the electric current to be supplied to the display 25 and (ii) the electric current to be supplied to the loudspeaker 27 can be controlled. Thus, decrease of the battery 1 can be slowed. Moreover, in a case where the display apparatus 20 boosts the voltage of the battery 1 to use the boosted voltage like this embodiment, when the voltage of the battery 1 decreases, a large electric current possibly flows in the wire harness 30. However, in this embodiment, when the voltage of the battery 1 decreases (or the voltage of the battery 1 is low) and the electric current consumption of the display 25 and the loudspeaker 27 is estimated to be high, the electric current control processing is performed. Thus, there is a low possibility that an electric current greater than the allowable electric current flows in the wire harness 30.

The electric current control processing may include a step that decreases the luminance of the image that is displayed on the display 25. In this embodiment, the electric current control processing decreases the luminance of the display 25. According to this, a relatively simple control that is performed by the controller 21 can decrease the sum of the electric currents to be supplied to the display 25 and the loudspeaker 27. Moreover, only when the image is bright, the luminance is decreased. Thus, a change to the image is less recognizable.

In order to decrease the luminance of the image, the step may uniformly decrease a ratio (duty cycle) of a lighting period of each OLED controlled, for example, in a pulse width modulation (PWM). A degree of decrease in the duty cycle is determined, for example, based on experiments. The controller 21 commands to the display controller 23 to decrease the duty cycle that is controlled in the PWM. The display controller 23 changes a condition of the PWM control in accordance with the command of the controller 21 and performs display control of the image based on the changed condition.

In a case where the step that decreases the luminance is performed, the step may decrease the luminance of all the colors RGB or the step may decrease the luminance only of a color (e.g. red and/or blue) of which change to the luminance is less recognizable for the user. Thus, the possibility that the user feels difficult to watch the image can be further reduced.

The electric current control processing may include a color tone change step that changes a color tone of the image that is displayed on the display 25. In this case, bright tone of the image can be changed to a darker tone so that the sum of the electric currents to be supplied to the display 25 and the loudspeaker 27 can be decreased. In a case where the color tone is changed, for example, the controller 21 may be configured to give a command of a color tone change to the image processor 22 that includes a function of color tone adjustment. The color tone change step may be performed instead of the step that decreases the luminance or may be performed in addition to the step that decreases the luminance.

Moreover, the electric current control processing may include a step that decreases the set volume of the loudspeaker 27. The controller 21 commands the sound processor 26 to decrease the set volume. In accordance to the command from the controller 21, the sound processor 26 changes the set volume and processes the sound signal based on the changed condition. In this configuration, too, it is possible to control the sum of the electric currents to be supplied to the display 25 and the loudspeaker 27.

The step that decreases the set volume of the loudspeaker 27 may be performed, for example, instead of the step that decreases the luminance or may be performed in addition to the step that decreases the luminance. In the case of the former, the electric current control processing can be performed by only changing the volume so that a possibility that the user may feel difficult to watch the image can be reduced. In the case of the latter, the sum of the electric currents to be supplied to the display 25 and the loudspeaker 27 can be controlled while striking a balance between the image and the sound.

When the step S5 ends, the controller 21 moves to a step S6. In the step S6, the controller 21 determines whether or not the voltage of the battery 1 is equal to or smaller than a predetermined voltage threshold. The predetermined voltage threshold in the step S6 is same as the predetermined voltage threshold in the step S2. When the voltage of the battery 1 is equal to or smaller than the predetermined voltage threshold (Yes in the step S6), the controller 21 moves to a next step S7. When the voltage of the battery 1 is greater than the predetermined voltage threshold (No in the step S6), the controller 21 moves to a step S9.

In the step S7, the controller 21 determines whether or not the set volume of the loudspeaker 27 is equal to or greater than a predetermined volume threshold. The predetermined volume threshold is same as the predetermined threshold in the step S3. When the set volume of the loudspeaker 27 is equal to or greater than the predetermined volume threshold (Yes in the step S7), the controller 21 moves to a next step S8. When the set volume of the loudspeaker 27 is smaller than the predetermined volume threshold (No in the step S7), the controller 21 moves to a step S9.

In the step S8, the controller 21 determines whether or not the estimated electric current consumption of the image is smaller than a predetermined electric current threshold. Herein described is a case in which the predetermined electric current threshold in the step S8 is same as the predetermined electric current threshold in the step S4. However, the predetermined electric current threshold in the step S8 may be different from the predetermined electric current threshold in the step S4. The estimated electric current consumption of the image is an electric current consumption estimated for one image frame. For example, the line values of the lines included in a frame are summed to calculate a frame value of the frame. When the brightness ratio that is calculated based on the frame value is smaller than the foregoing predetermined brightness ratio threshold, the controller 21 determines that the estimated electric current consumption is smaller than the predetermined electric current threshold. Moreover, when the brightness ratio that is calculated based on the frame value is equal to or greater than the predetermined brightness ratio threshold, the controller 21 determines that the estimated electric current consumption is equal to or greater than the predetermined electric current threshold. When the controller 21 determines that the estimated electric current consumption of the image is smaller than the predetermined electric current threshold (Yes in the step S8), the controller 21 moves to the next step S9. When the controller 21 determines that the estimated electric current consumption of the image is equal to or greater than the predetermined electric current threshold (No in the step S8), the controller 21 moves back to the step S5. During the steps from the step S6 to the step S8, the electric current control is maintained.

In the step S9, the controller 21 ends the electric current control. More specifically, the controller 21 increases the luminance decreased in the step S5 to be the luminance before the step S5. When the step S9 ends, the controller 21 moves back to the step S2. While the display apparatus 20 is displaying images and outputting sound, the foregoing processing is repeated.

According to this embodiment, even during the calculation of a sum for one frame (sum of the line values), when the brightness ratio reaches the predetermined brightness ratio threshold, the electric current control processing is performed because the electric current consumption of the display 25 is determined to be equal to or greater than the predetermined electric current threshold. In other words, the electric current control processing can be performed responsively.

3. MODIFICATIONS

3-1. First Modification

In the configuration of the foregoing embodiment, the electric current consumption of the display 25 is determined based on a frame of the images. However, this configuration is only an example. The electric current consumption of the display 25 may be determined, for example, based on a plurality of frames of the images or based on scan lines less than all scan lines in a frame.

3-2. Second Modification

In the configuration of the foregoing embodiment, the controller 21 determines, based on the estimated electric current consumption of the display 25 and the set volume of the loudspeaker 27, whether or not the electric current control processing is performed. However, the configuration is only an example. For example, the controller 21 may perform the electric current control processing when a set volume of the loudspeaker 27 is equal to or greater than a predetermined volume. The controller 21 may not use the estimated electric current consumption of the display 25 to determine whether or not the controller 21 performs the electric current control processing.

For example, when the set volume of the loudspeaker 27 is equal to or greater than the predetermined volume and a voltage of the battery 1 is equal to or smaller than a predetermined voltage threshold, the controller 21 may perform the electric current control processing. In this case, the electric current control processing may be processing that decreases an electric current to be supplied to the display 25. Thus, when an electric current to be supplied to the display apparatus 20 is estimated to be high, the controller 21 can control a sum of the electric currents to be supplied to the display 25 and the loudspeaker 27 to properly control an electric current flow greater than the allowable electric current in the wire harness 30. In addition to the processing that decreases the electric current to be supplied to the display 25, processing that decreases the set volume of the loudspeaker 27 may be included in the electric current control processing. Moreover, the controller 21 may perform the electric current control processing when an output volume (an example of the sound information) from the loudspeaker 27, instead of the set volume of the loudspeaker 27, is equal to or greater than a predetermined volume threshold. When the set volume is a greatest value but no sound or calm sound is output, the electric current control processing is unnecessary. According to this configuration, thoughtful electric current control processing can be performed in consideration of such a case.

Moreover, for example, when an electric current consumption of the display 25 is estimated to be equal to or greater than a predetermined electric current threshold and the voltage of the battery 1 is equal to or smaller than a predetermined voltage threshold, the controller 21 may perform electric current control that lowers the set volume of the loudspeaker 27.

3-3. Third Modification

Figure 5:
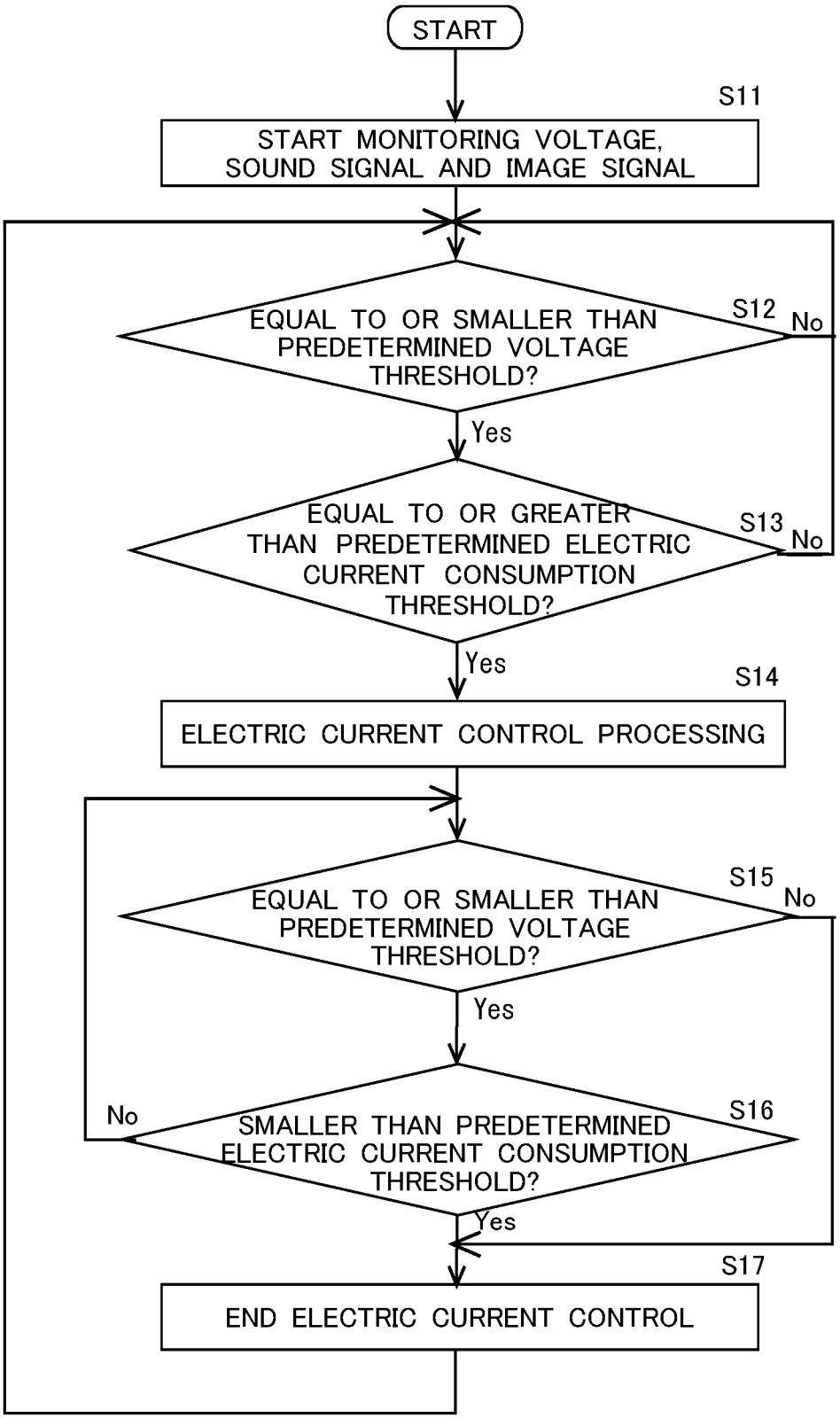
FIG. 5 is a flowchart showing a modification of the electric current control that is performed by the display apparatus.

FIG. 5 is a flowchart showing a modification of the electric current control that is performed by the display apparatus 20. In the modification shown in FIG. 5, the controller 21 performs electric current control processing when a sum of an estimated electric current consumption of the display 25 and an estimated electric current consumption of the loudspeaker 27 is equal to or greater than a predetermined electric current consumption threshold. The estimated electric current consumption of the display 25 is calculated based on image information and the estimated electric current consumption of the loudspeaker 27 is calculated based on sound information. As for elements in FIG. 5 that are same elements in FIG. 4, explanation will be omitted if no additional explanation is necessary.

In a step S11, voltage monitoring, sound signal monitoring and image signal monitoring are started. The sound signal monitoring is for monitoring the electric current consumption of the loudspeaker 27. For example, the sound processor 26 calculates the estimated electric current consumption of the loudspeaker 27 based on a signal level of a sound signal temporarily stored in a buffer, not illustrated, and a set volume of the loudspeaker 27. The controller 21 may calculate the estimated electric current consumption. The controller 21 starts monitoring of a sum of the estimated electric current consumption of the display 25 that is calculated based on an image signal and the estimated electric current consumption of the loudspeaker 27.

The estimated electric current consumption of the display 25 may be calculated based on pixel value information included in the image information, as described above. Moreover, the estimated electric current consumption of the display 25 and the estimated electric current consumption of the loudspeaker 27 vary over time. Therefore, the sum of the estimated electric current consumptions of the display 25 and the loudspeaker 27 is calculated by summing the electric current consumptions estimated when the display 25 and the loudspeaker 27 output image/sound at a same time.

In a step S12, the controller 21 determines whether or not a voltage of the battery 1 is equal to or smaller than a predetermined voltage threshold. When the voltage of the battery 1 is equal to or smaller than the predetermined voltage threshold (Yes in the step S12), the controller 21 moves to a next step S13. When the voltage of the battery 1 is greater than the predetermined voltage threshold (No in the step S12), the controller 21 repeats the step S12 that is a determination step.

In the step S13, the controller 21 determines whether or not the sum of the estimated electric current consumptions of the display 25 and the loudspeaker 27 is equal to or greater than the predetermined electric current consumption threshold. The predetermined electric current consumption threshold may be determined from, for example, experiments, in consideration of preventing an electric current flow greater than an allowable electric current in the wire harness 30 even when the voltage of the battery 1 decreases or is low. When the sum of the estimated electric current consumptions of the display 25 and the loudspeaker 27 is equal to or greater than the predetermined electric current consumption threshold (Yes in the step S13), the controller 21 moves to a next step S14. When the sum of the estimated electric current consumptions of the display 25 and the loudspeaker 27 is smaller than the predetermined electric current consumption threshold (No in the step S13), the controller 21 moves back to the step S12.

In the step S14, the controller 21 performs the electric current control processing that decreases a sum of electric currents to be supplied to the display 25 and the loudspeaker 27. The electric current control processing may decrease one or both of (i) the electric current to be supplied to the display 25 and (ii) the electric current to be supplied to the loudspeaker 27. For example, one or both of (i) processing that decreases a luminance of an image that is displayed on the display 25 and (ii) processing that decreases the set volume of the loudspeaker 27 may be performed. When the step S14 ends, the controller 21 moves to a next step S15.

In the step S15, the controller 21 determines whether or not the voltage of the battery 1 is equal to or smaller than the predetermined voltage threshold. When the voltage of the battery 1 is equal to or smaller than the predetermined voltage threshold (Yes in the step S15), the controller 21 moves to a step S16. When the voltage of the battery 1 is greater than the predetermined voltage threshold (No in the step S15), the controller 21 moves to a step S17.

In the step S16, the controller 21 determines whether or not the sum of the estimated electric current consumptions of the display 25 and the loudspeaker 27 is smaller than a predetermined electric current consumption threshold. The predetermined electric current consumption threshold is same as the predetermined electric current consumption threshold in the step S13. When the controller 21 determines that the sum of the estimated electric current consumptions of the display 25 and the loudspeaker 27 is smaller than the predetermined electric current consumption threshold (Yes in the step S16), the controller 21 moves to the step S17. When the controller 21 determines that the sum of the estimated electric current consumptions of the display 25 and the loudspeaker 27 is equal to or greater than the predetermined electric current consumption threshold (No in the step S16), the controller 21 moves back to the step S15. During the steps from the step S15 to the step S16, the electric current control is maintained.

In the step S17, the controller 21 ends the electric current control. When the step S17 ends, the controller 21 moves back to the step S12. While the display apparatus 20 is displaying images, the foregoing processing is repeated.

According to the configuration of the modification shown in FIG. 5, only when the sum of the electric currents to be consumed by the display 25 and the loudspeaker 27 is large, the electric current control processing is performed. Thus, a possibility can be reduced that the user feels difficult to watch the image or the user feels a volume of the sound is low. Moreover, since this embodiment is configured to monitor both the electric current consumption to be consumed by the display 25 and the electric current consumption to be consumed by the loudspeaker 27, an electric current that flows in the wire harness 30 can be more properly controlled.

3-4. Fourth Embodiment

Figure 6:
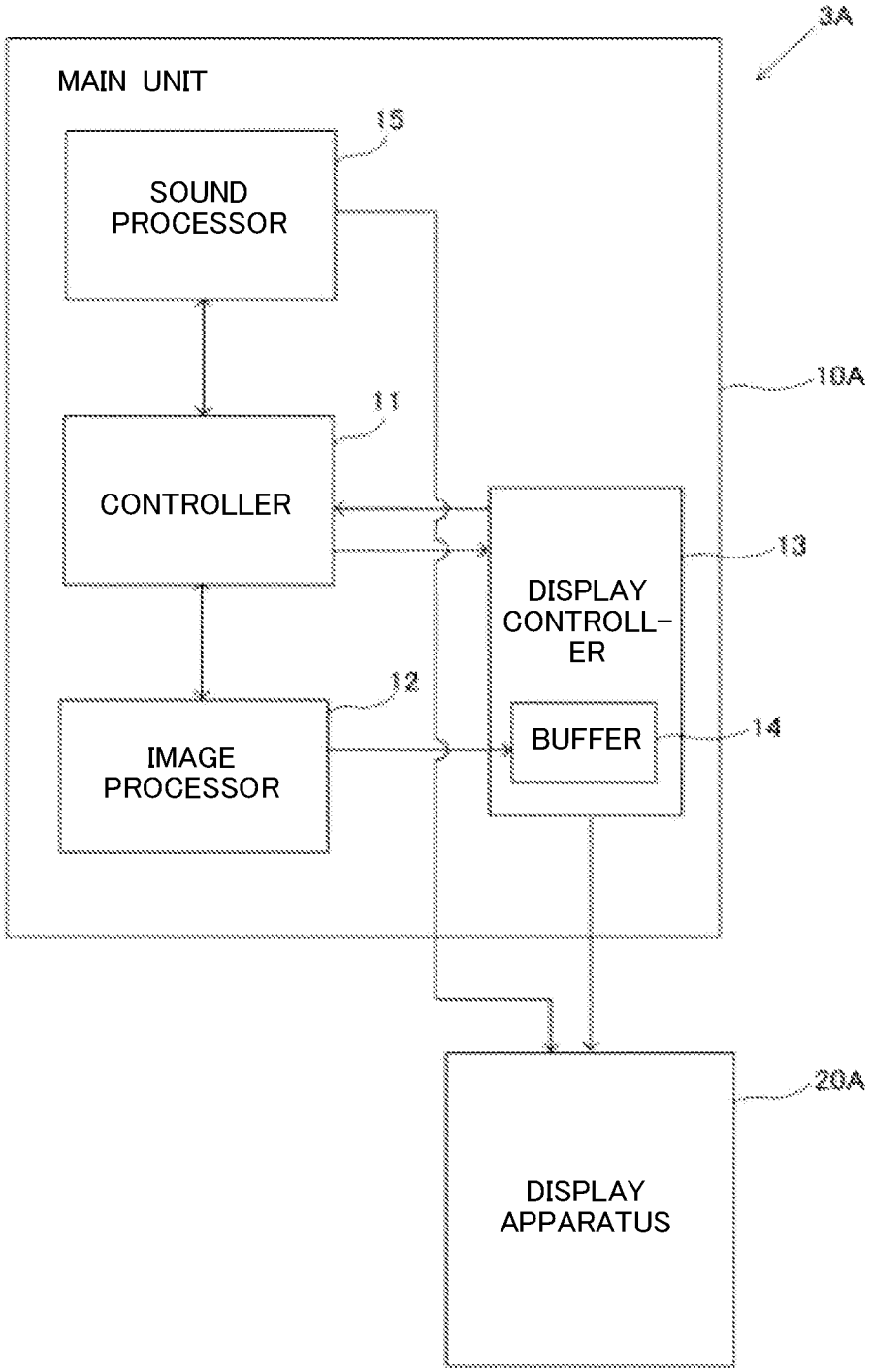
FIG. 6 is a block diagram showing a modification of the display system.

FIG. 6 is a block diagram showing a modification of the display system 3 of the embodiment. A display system 3A of this modification includes a main unit 10A and a display apparatus 20A. The main unit 10A and the display apparatus 20A is connected to each other by a wire harness 30 similarly to the foregoing embodiment although the wire harness 30 is not illustrated in FIG. 6.

In the display system 3A of this modification, electric current control processing that controls a sum of electric currents to be supplied to a display and a loudspeaker of the display apparatus 20A is performed by the main unit 10A, instead of the display apparatus 20A. Thus, the main unit 10A includes a controller 11, an image processor 12, a display controller (calculator) 13, a buffer 14, and a sound processor 15. Those elements 11 to 15 have same configuration as the controller 21, the image processor 22, the display controller (calculator) 23, the buffer 24, and the sound processor 26 of the display apparatus 20, respectively, described in the foregoing embodiment. Therefore, detailed explanation of those elements is omitted.

The controller 11 performs the electric current control processing that controls a sum of electric currents to be supplied to the display and the loudspeaker based on one or both of (i) information of an image that is displayed on the display and (ii) information of sound that is output from the loudspeaker of the display apparatus 20A. According to this modification, when an electric current consumption of the display apparatus 20A is estimated to be large by the main unit 10A from one or both of (i) the image information and (ii) the sound information, a command relating to the electric current control is sent to the display apparatus 20A from the main unit 10A. Thus, the electric current consumption in the display apparatus 20A can be reduced. In other words, according to this modification, an electric current flow greater than an allowable electric current in the wire harness 30 can be properly prevented. The configuration of this modification is preferable in a case where a high performance integrated circuit is not included in the display apparatus 20A.

3-5. Fifth Modification

Figure 7:
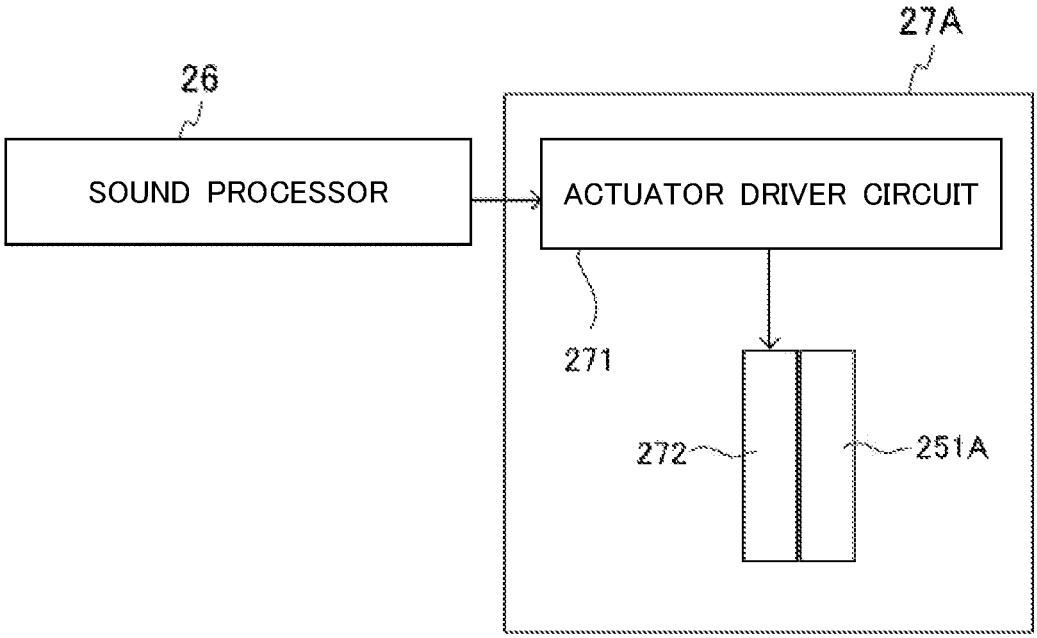
FIG. 7 is a schematic diagram for explanation of a modification of a loudspeaker included in the display apparatus.

FIG. 7 is a schematic diagram for explanation of a modification of a loudspeaker included in the display apparatus 20 or the display apparatus 20A. A loudspeaker 27A of the display apparatus 20 or the display apparatus 20A, as shown in FIG. 7, may be a display speaker that outputs sound by vibrating a display panel 251A (OLED panel, etc.) included in a display 25. Since the loudspeaker is a display speaker, no space is necessary for parts for a loudspeaker near the display panel so that the loudspeaker can be miniaturized.

The loudspeaker 27A includes an actuator driver circuit 271 and an actuator 272, in addition to the display panel 251A. The actuator driver circuit 271 includes a D/A converter and an amplifier, not illustrated. The D/A converter converts a digital signal (sound signal) that is output from the sound processor 26 into an analog signal. The amplifier amplifies the analog signal converted by the D/A converter to generate an actuator drive signal and sends the actuator drive signal to the actuator 272.

The actuator 272 is activated in accordance with the actuator drive signal to vibrate the display panel 251A. Sound is output by vibration of the display panel 251A based on vibration of the actuator 272. The actuator 272 may be, for example, a piezoelectric element (voltage element) or a solenoid. The actuator 272 is disposed on a backside of the display panel 251A. The actuator 272 is fixed on the backside of the display panel 251A via, for example, adhesive.

4. NOTES

In the foregoing embodiment and modifications, various changes can be made to the technical features disclosed in the foregoing description to devise numerous other modifications and variations without departing from the scope of the invention. In other words, the foregoing description is in all aspects illustrative and not restrictive. The scope of this invention should be defined by the scope of the invention, not by the foregoing embodiment and modifications. All modifications and changes that are equivalent to the scope of the invention should be included in the scope of the invention. Moreover, the embodiment and the modifications may be properly combined with one another.

What is claimed is:

1. A display apparatus comprising:

a display;

a loudspeaker; and a controller that is configured to: perform, based on both of (i) image information of an image that is displayed on the display, and (ii) sound information of sound that is output from the loudspeaker, electric current control processing that controls a sum of an electric current to be supplied to the display and an electric current to be supplied to the loudspeaker.

2. The display apparatus according to claim 1, wherein the sound information includes a set volume of the sound that is output from the loudspeaker, and the controller is configured to perform the electric current control processing to decrease the electric current to be supplied to the display when the set volume of the sound that is output from the loudspeaker is equal to or greater than a predetermined volume threshold.

3. The display apparatus according to claim 1, wherein the sound information includes an output volume of the sound that is output from the loudspeaker, and the controller is configured to perform the electric current control processing to decrease the electric current to be supplied to the display when the output volume of the sound that is output from the loudspeaker is equal to or greater than a predetermined volume threshold.

4. The display apparatus according to claim 1, wherein the image information includes a luminance of the display, and the controller is configured to perform the electric current control processing to decrease the electric current to be supplied to the loudspeaker when the luminance of the display is equal to or greater than a predetermined luminance threshold.

5. The display apparatus according to claim 1, wherein the controller is further configured to:

receive, from the display, an arithmetic value for electric current consumption of the display, the arithmetic value being calculated based on pixel value information that is included in the image information;

estimate the electric current consumption of the display based on the arithmetic value that was received; and perform the electric current control processing when (i) the estimated electric current consumption of the display is equal to or greater than a predetermined electric current threshold and (ii) a set volume of the loudspeaker is equal to or greater than a predetermined volume threshold, the set volume being included in the sound information.

6. The display apparatus according to claim 1, wherein the controller is configured to perform the electric current control processing when a sum of an estimated electric current consumption of the display and an estimated electric current consumption of the loudspeaker is equal to or greater than a predetermined electric current consumption threshold, the estimated electric current consumption of the display being calculated based on the image information, and the estimated electric current consumption of the loudspeaker being calculated based on the sound information.

7. The display apparatus according to claim 1, wherein the controller is configured to perform the electric current control processing when a voltage value of a battery, which is a power source of the display apparatus, is equal to or smaller than a predetermined voltage threshold.

8. The display apparatus according to claim 1, wherein the electric current control processing includes processing that decreases a volume of the loudspeaker.

9. The display apparatus according to claim 1, wherein the electric current control processing includes processing that decreases a luminance of the image that is displayed on the display.

10. The display apparatus according to claim 1, wherein the electric current control processing includes processing that changes a color tone of the image that is displayed on the display.

11. The display apparatus according to claim 1, wherein the loudspeaker is a display speaker that outputs the sound by vibrating a display panel included in the display.

12. The display apparatus according to claim 1, wherein the display apparatus is connected by a wire harness to a main unit that is installed in a vehicle in which the display apparatus is installed.

13. A display system comprising:

a main unit that is installed in a vehicle; and a display apparatus that is connected to the main unit by a wire harness and that is supplied with electric power by the wire harness;

wherein the main unit includes:

a controller that is configured to perform, based on both of (i) image information of an image that is displayed on a display included in the display apparatus, and (ii) sound information of sound that is output from a loudspeaker included in the display apparatus, electric current control processing that controls a sum of an electric current to be supplied to the display and an electric current to be supplied to the loudspeaker.

14. A display control method of a display apparatus having a display, the method comprising a step of:

performing, based on both of (i) image information of an image that is displayed on the display, and (ii) sound information of sound that is output from a loudspeaker, electric current control processing that controls a sum of an electric current to be supplied to the display and an electric current to be supplied to the loudspeaker.

* * * * *